United States Patent [19]

Vollers

[11] 4,444,329

[45] Apr. 24, 1984

[54] CONTAINER CAP AND SEAL FORMATION OF INDICIA

[76] Inventor: Gary L. Vollers, 11471 Tampa Ave., No. 149, Northridge, Calif. 91326

[21] Appl. No.: 428,356

[22] Filed: Sep. 29, 1982

[51] Int. Cl.[3] ..... B65D 53/04

[52] U.S. Cl. ..... 215/230; 40/311; 215/350

[58] Field of Search ..... 215/230, 365, 366, 350, 215/349, 203, 341; 40/311; 264/268, 247, 246; 29/527.4

[56] References Cited

U.S. PATENT DOCUMENTS

| | | | |
|---|---|---|---|
| 209,466 | 10/1878 | Dabbs | 40/311 |
| 1,189,465 | 7/1916 | Mayo | 215/247 |
| 1,257,710 | 2/1918 | Januchowsky | 40/311 X |
| 2,608,334 | 8/1952 | Knocke . | |
| 2,663,910 | 12/1953 | Danielson et al. | 264/247 |
| 3,086,250 | 4/1963 | Gits | 264/247 X |
| 3,208,649 | 9/1965 | Fields | 215/230 X |
| 3,232,471 | 2/1966 | Prothe | 215/350 X |
| 3,329,295 | 7/1967 | Fields . | |
| 3,346,134 | 10/1967 | Leemann | 215/230 X |
| 3,413,743 | 12/1968 | Goodhue | 40/311 |
| 3,438,528 | 4/1969 | Fields . | |
| 3,441,161 | 4/1969 | Van Baarn . | |
| 3,673,761 | 7/1972 | Leitz . | |
| 3,812,991 | 5/1974 | Wurl | 215/252 |
| 3,861,551 | 1/1975 | Hannon | 215/252 |
| 4,033,472 | 7/1977 | Aichinger | 215/256 X |
| 4,126,240 | 11/1978 | Brach | 215/252 |
| 4,206,851 | 6/1980 | Ostrowsky | 215/246 |

*Primary Examiner*—Donald F. Norton
*Attorney, Agent, or Firm*—William W. Haefliger

[57] ABSTRACT

A bottle cap seal cooperates with the top wall of a bottle cap so as to provide visible indicia.

1 Claim, 7 Drawing Figures

CONTAINER CAP AND SEAL FORMATION OF INDICIA

BACKGROUND OF THE INVENTION

This invention relates generally to bottle caps and, more particularly, concerns the forming of indicia on such caps.

In the past, identifying or advertising indicia were emplaced on bottle cap top walls, as by printing. Inasmuch as printing adds to the cost of the cap, and requires extra handling, there is a need to eliminate printing but while somehow achieving indicia formation. Also, there has been a continuing need for method or means to retain bottle cap seals in position and against inadvertent removal.

SUMMARY OF THE INVENTION

It is a major object of the invention to provide an improved cap assembly which meets the above need, or needs. As will appear, this objective is met by providing a bottle cap assembly that comprises:

(a) a cap top wall integrally joined to a cap side wall having inner and outer sides, (b) and a seal in the cap and extending adjacent the cap top wall inner side, (c) the cap top wall having at least one through aperture therein, and the seal extending in such relation to the aperture to be visible from the cap exterior and at said aperture or apertures.

Further, the seal itself may extend into multiple apertures in the cap top wall and to full or partial depth or depths of the apertures; the seal projections in the apertures may interlock to same to retain the seal layer in position at the underside of the top wall; and the aperture or apertures may form alphanumeric characters.

It is a further object of the invention to provide a method of forming such indicia, the method including:

(a) providing said top wall to have at least one through aperture therein, and (b) providing a seal in the cap to extend adjacent the cap top wall inner side, and to be visible from the cap exterior at said aperture or apertures.

These and other objects and advantages of the invention, as well as the details of an illustrative embodiment, will be more fully understood from the following specification and drawings, in which:

DRAWING DESCRIPTION

DETAILED DESCRIPTION

Figure 1:
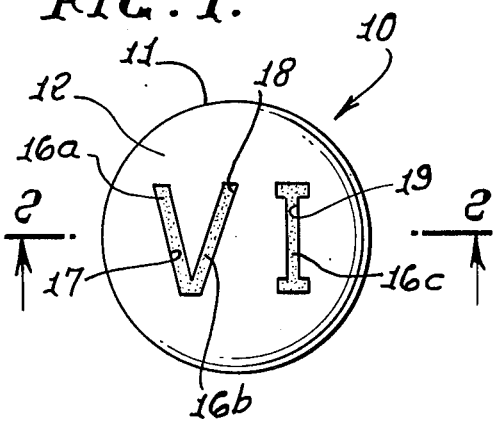
FIG. 1 is a plan view of a bottle cap incorporating the invention.
Figure 3:
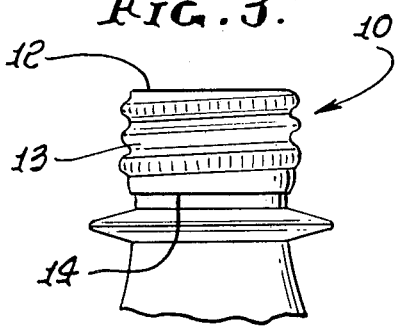
FIG. 3 is a fragmentary elevation.
Figure 2:
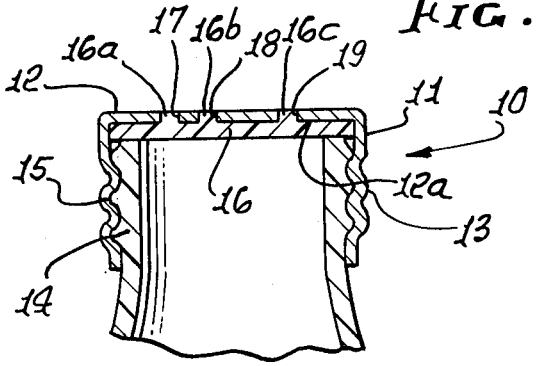
FIG. 2 is a section taken on lines 2—2 of FIG. 1.

In FIGS. 1-3, a bottle cap assembly 10 includes a bottle cap 11 having a top wall 12 integrally and peripherally joined to a side wall or skirt 13 adapted to be applied to a bottle neck, as at 14. The bottle neck and cap skirt may have interengaged threads as at 15, with the neck projecting into the cap interior. The cap 11 may consist of metal such as aluminum, for example, and is thin-walled and bendable. Very often it is desired that identifying and advertising indicia be formed on the top of the cap, which required a printing operation, in the past, such printing adding to the cost of the cap.

A seal layer or liner 16 is provided in the cap to extend adjacent the inner side **12*a* of the top wall 12. In accordance with the invention the wall 12 has at least one through aperture therein, and the seal extends in such adjacent relation to the aperture as to be visible from the exterior (i.e. top side) of the cap, at the aperture or apertures. In this example, the apertures form the indicia "V I", and have multiple lengths 17, 18 and 19 as shown, extending through the cap wall 12. Further, the seal extends into the apertures, as for example at 16*a*, 16*b* and 16*c*, into the lengths 17–19, respectively as shown. Thus, the seal extents 16*a*–16*c* may extend throughout the full depths of the apertures, to fill same and have top surfaces substantially flush with the top surface of the cap. As a result, the need for separately printed indicia V I is obviated and also the seal extents in the apertures assist in retaining the seal layer 16 in position. The apertures 17–19** may be formed at the same time that the cap is formed, as by stamping for example, and may take the form of alphanumeric characters. The seal may consist of an elastomer such as rubber, or a suitable synthetic resin, molded in situ.

Figure 4:
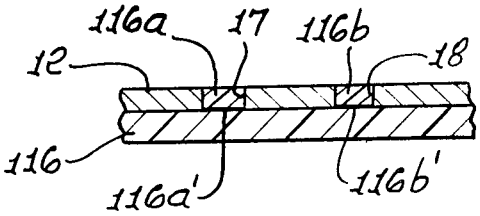
FIG. 4 is an enlarged section showing a modification.

FIG. 4 shows a modification wherein the cap 11 is the same as before. Seal layer or liner 116 corresponds to layer 16. Separate seal material **116*a* and 116*b* projects into the apertures 17 and 18, and may be joined (i.e.-bonded) to the layer 16 at interfaces 116*a*′ and 116*b*′**.

Figure 5:
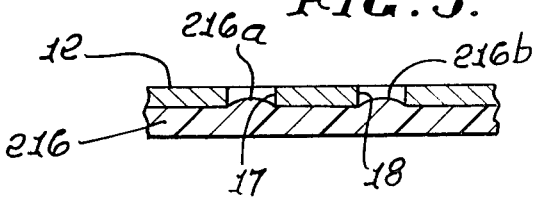
FIG. 5 is an enlarged section showing another modification.

In FIG. 5, the cap 11 is again the same as before. Seal layer 216 corresponds to seal layer 16. The apertures 17 and 18 are not filled with seal material, but the latter is visible through the apertures. See for example seal bulges at **216*a* and 216*b*** at the bottoms of the apertures.

Figure 6:
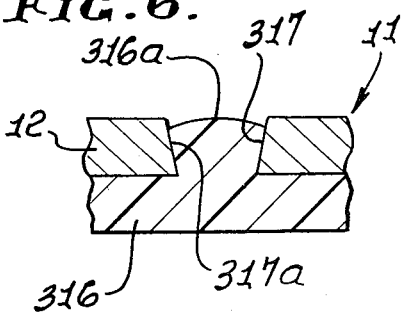
FIG. 6 is an enlarged section showing yet another modification.

In FIG. 6 the cap 11 is again the same as before. Seal layer 316 corresponds to layer 16. The seal extent **316*a* in aperture 317 retains layer 316 in position, as for example by interlocking to the cap top 12. The form of interlock shown comprises downwardly tapered wall or walls 317*a*** of the aperture.

Figure 7:
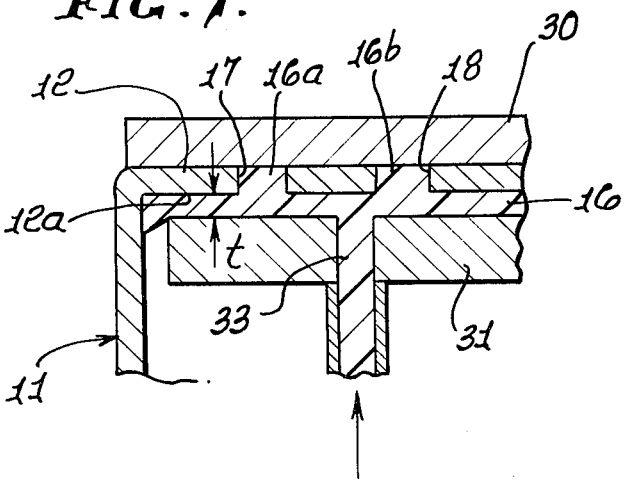
FIG. 7 is an enlarged vertical section showing a molding operation.

FIG. 7 illustrates molding of the seal 16 layer and projections **16*a* and 16*b* in position in the apertures 17 and 18. For this purpose external mold section 30 covers the cap top, and internal mold section 31 extends across the cap interior at distance "t" from the cap top wall inner side 12*a*. Elastomeric or other seal material is then injected as at 33 into the cap to form layer 16 and projections 16*a* and 16*b***. The mold sections are then withdrawn.

I claim:

1. An indicia presenting bottle cap assembly comprising:

(a) a cap top wall integrally joined to a cap side wall having threading adapted to be applied to a bottle neck, the top wall having inner and outer sides, (b) and a resinous seal in the cap and extending as a continuous layer adjacent substantially the entirety of the cap top wall inner side, (c) the cap top wall having multiple through apertures therein and extending in multiple and different directions in a plane defined by said top wall, and the seal extending in such relation to the apertures to be visible from the cap exterior and at said apertures, (d) the seal having protruding portions extending into said apertures but entirely confined below the level of said cap top wall outer side, (e) said seal protruding portions in said apertures defining an alphanumeric character or characters, (f) said apertures having walls and said seal protruding portions in said apertures being interlocked with the aperture walls, (g) the seal being everywhere spaced from said threading.

* * * * *